US009957714B2

(12) United States Patent
Carolan et al.

(10) Patent No.: US 9,957,714 B2
(45) Date of Patent: May 1, 2018

(54) COMPOSITE INSULATING AND CLADDING PANEL

(71) Applicant: Kingspan Holdings (IRL) Limited, County Cavan (IE)

(72) Inventors: James Carolan, County Cavan (IE); Gregory Flynn, County Louth (IE)

(73) Assignee: Kingspan Holdings (IRL) Limited, Kingscourt, County Cavan (IE)

( * ) Notice: Subject to any disclaimer, the term of this patent is extended or adjusted under 35 U.S.C. 154(b) by 0 days. days.

(21) Appl. No.: 14/648,994

(22) PCT Filed: Dec. 2, 2013

(86) PCT No.: PCT/EP2013/075286
§ 371 (c)(1),
(2) Date: Jun. 2, 2015

(87) PCT Pub. No.: WO2014/086729
PCT Pub. Date: Jun. 12, 2014

(65) Prior Publication Data

US 2015/0300017 A1 Oct. 22, 2015

(30) Foreign Application Priority Data

Dec. 3, 2012 (EP) ..... 12195240
Dec. 3, 2012 (IE) ..... 2012/0522

(51) Int. Cl.
*E04C 2/284* (2006.01)
*E04C 2/34* (2006.01)
(Continued)

(52) U.S. Cl.
CPC ..... *E04C 2/284* (2013.01); *E04B 2/721* (2013.01); *E04C 2/292* (2013.01); *E04C 2/296* (2013.01);
(Continued)

(58) Field of Classification Search
CPC . B32B 3/14; E04C 2/284; E04C 2/292; E04C 2/296; E04C 2/34; E04C 2/38;
(Continued)

(56) References Cited

U.S. PATENT DOCUMENTS 1,657,193 A * 1/1928 Beshers ..... E04C 2/284 428/120
3,474,583 A * 10/1969 Manias ..... E04B 1/7612 52/235
(Continued)

FOREIGN PATENT DOCUMENTS

EP 0145675 A2 6/1985
GB 2421254 A * 6/2006 ..... E04C 2/292
(Continued)

OTHER PUBLICATIONS

1. Kang KR 2005122725 A (Pubn-Date: Dec. 29, 2005) EPO Machine Translation "Description" Generated Sep. 15, 2015; 2. KR 20050122725 A (Pubn-Date: Dec. 29, 2005) Original Document.*
(Continued)

*Primary Examiner* — Charles A Fox
*Assistant Examiner* — Joseph J. Sadlon
(74) *Attorney, Agent, or Firm* — Harness, Dickey & Pierce, P.L.C.

(57) ABSTRACT

A composite insulating and cladding panel has a backing sheet, a plurality of cladding parts, and a support grid between the backing sheet and the cladding parts. The cladding parts are mounted to the support grid and a body of insulating material such as insulating foam. The cladding parts are spaced-apart to provide gaps. The cladding parts may have any desired surface finish. The cladding parts provide a finished façade. The panel incorporates a support grid that transfers load directly to a building structural framework. The panels also have interengagable features
(Continued)

that facilitate joining between a plurality of panels to form a finished façade.

16 Claims, 16 Drawing Sheets

(51) Int. Cl.

| | |
|---|---|
| ***E04C 2/38*** | (2006.01) |
| ***E04C 2/42*** | (2006.01) |
| ***E04B 2/72*** | (2006.01) |
| ***E04C 2/292*** | (2006.01) |
| ***E04C 2/296*** | (2006.01) |
| ***E04F 13/08*** | (2006.01) |
| ***E04F 13/12*** | (2006.01) |

(52) U.S. Cl.
CPC ..... *E04C 2/34* (2013.01); *E04C 2/38* (2013.01); *E04C 2/384* (2013.01); *E04C 2/42* (2013.01); *E04F 13/0803* (2013.01); *E04F 13/12* (2013.01)

(58) Field of Classification Search
CPC ..... E04C 2/384; E04C 2/42; E04F 13/0862; E04F 13/12; E04B 2/721
USPC ..... 52/483.1
See application file for complete search history.

(56) References Cited

U.S. PATENT DOCUMENTS 3,646,180 A 2/1972 Winnick
3,715,848 A * 2/1973 Jordan ..... E04B 1/62 52/202
3,748,799 A * 7/1973 Tough ..... E04B 32/825 181/290
4,009,543 A * 3/1977 Smrt ..... E04B 1/3211 52/222
4,506,484 A * 3/1985 Bartlett ..... E04B 2/90 52/235
5,598,671 A * 2/1997 Ting ..... E06B 7/14 52/234
5,678,369 A * 10/1997 Ishikawa ..... B32B 3/02 52/309.7
5,787,677 A * 8/1998 Bolich ..... B32B 11/10 181/294
5,839,236 A * 11/1998 Frey ..... E04B 32/965 52/235
5,950,386 A * 9/1999 Shipman ..... A47B 57/425 52/239
6,122,879 A * 9/2000 Montes ..... E04C 2/292 52/309.9
6,233,892 B1 * 5/2001 Tylman ..... E04B 7/22 52/309.12
6,484,465 B2 * 11/2002 Higgins ..... E04F 13/081 52/235
6,748,709 B1 * 6/2004 Sherman ..... E04B 2/96 52/235
7,520,093 B2 * 4/2009 Guhl ..... E06B 3/5454 52/204.1
7,562,509 B2 * 7/2009 Ness ..... E04F 13/081 52/235
7,621,084 B2 * 11/2009 Bilge ..... E04F 13/0814 52/235
8,046,971 B2 * 11/2011 Lima ..... E04C 2/386 52/309.7
8,769,898 B2 * 7/2014 Carolan ..... E04B 2/90 52/235
8,769,900 B2 * 7/2014 MacDonald ..... E04B 2/842 52/483.1
8,984,838 B2 * 3/2015 Bordener ..... E04B 1/68 52/483.1
2012/0167517 A1 * 7/2012 Ruiz ..... E04B 1/41 52/582.1
2012/0231231 A1 * 9/2012 Curtin ..... E04C 2/292 428/192

FOREIGN PATENT DOCUMENTS

GB 2421254 A 6/2006
KR 2005122725 A * 12/2005
KR 20050122725 A 12/2005
WO WO-2011150035 A2 * 12/2011 ..... E04F 13/0805

OTHER PUBLICATIONS

International Search Report and Written Opinion for PCT/EP2013/075286, dated Mar. 6, 2014; ISA/EP.

* cited by examiner

COMPOSITE INSULATING AND CLADDING PANEL

CROSS REFERENCE TO RELATED APPLICATIONS

This application is a U.S. National Phase Application under 35 U.S.C. 371 of International Application No. PCT/EP2013/075286 filed on Dec. 2, 2013 and published as WO 2014/086729 A1 on Jun. 12, 2014. This application is based on and claims the benefit of priority from Irish Application No. 2012/0522 filed on Dec. 3, 2012 and European Application No. 12195240.2 filed on Dec. A 3, 2012. The entire disclosures of all of the above applications are incorporated herein by reference.

INTRODUCTION

This invention relates to a composite insulating and cladding panel.

Composite insulating panels comprising inner and outer metallic sheets with a filling of an insulating material therebetween are widely used for cladding buildings. It is also known to mount various façade elements such as brick or stone finishes to such composite insulating panel. Generally, support rails are attached to composite panels on site and façade elements are mounted to these rails. One such system is described in our GB2421254A.

Korean patent application KR 2005 0122725 describes an interior finishing board. EP 0 145 675 describes a panel-shaped composite material for covering floors and walls. U.S. Pat. No. 3,646,180 has a foam-cored wall panel. None are suitable for providing a finished façade which is integrated into a panel during manufacture. Also none of the products described in these documents has a support grid which transfers load directly to a building structural framework.

There is a need for an improved façade system.

STATEMENTS OF INVENTION

According to the invention there is provided a composite insulating and cladding panel comprising:

- a backing sheet;
- a plurality of cladding parts;
- a support grid between the backing sheet and the cladding parts; and
- a body of insulating material between the backing sheet, the support grid and the cladding parts.

One or more panels of the invention can provide a finished façade which is integrated into the panel during manufacture. The support grid is suitable for transferring load directly to a building structural framework. It does so without a requirement for separate additional building structural frames.

The panel of the invention can be used to clad buildings by being applied to a building structural building. It used to clad the exterior of buildings.

In one embodiment the support grid comprises:

- a male adaptor edge element having a male projecting part extending along one edge of the panel; and
- a female adaptor edge element having a female recess part extending along an opposite edge of the panel.

In one arrangement the male and female adaptor edge elements when mated conceal and fixings used to attach the panel to the building structure.

The support grid may comprise a plurality of mullion elements extending between the female adaptor edge element and the male adaptor edge element. A plurality of connectors may extend between the mullion elements.

The mullion element(s) can thus be assembled in any desired arrangement between the female adaptor edge element and the male adaptor edge element to support different cladding elements.

In one embodiment the support grid comprises frame adaptor elements for the cladding parts.

Typically the frame adapter element is used to frame individual cladding parts.

The frame adaptor elements can attach to one or more of the male adaptor edge element, the female adaptor edge element or a mullion. The frame adaptor elements desirably attaches to both the male adaptor edge element and the female adaptor edge element.

Desirably where there is more than one cladding part in a panel a frame adapter element may be used to frame individual cladding parts.

Where the frame adapter element is used to frame individual cladding parts the frame for the individual cladding parts is attached to the both the male adaptor edge element and the female adaptor edge element; one of the male adaptor edge element and the female adaptor edge element and a mullion; or more than one mullion.

The cladding parts may be spaced-apart to define gaps between adjacent cladding parts.

In some embodiments each cladding part is generally rectilinear tray shape having inturned edges. The edges may have rounded corner portions.

The invention also provides a cladding system comprising a plurality of panels according to the invention.

Also provided is a cladding system comprising a plurality of panels according to the invention.

BRIEF DESCRIPTION OF THE DRAWINGS

The invention will be more clearly understood from the following description of an embodiment thereof, given by way of example only, with reference to the accompanying drawings, in which.

DETAILED DESCRIPTION

Figure 1:
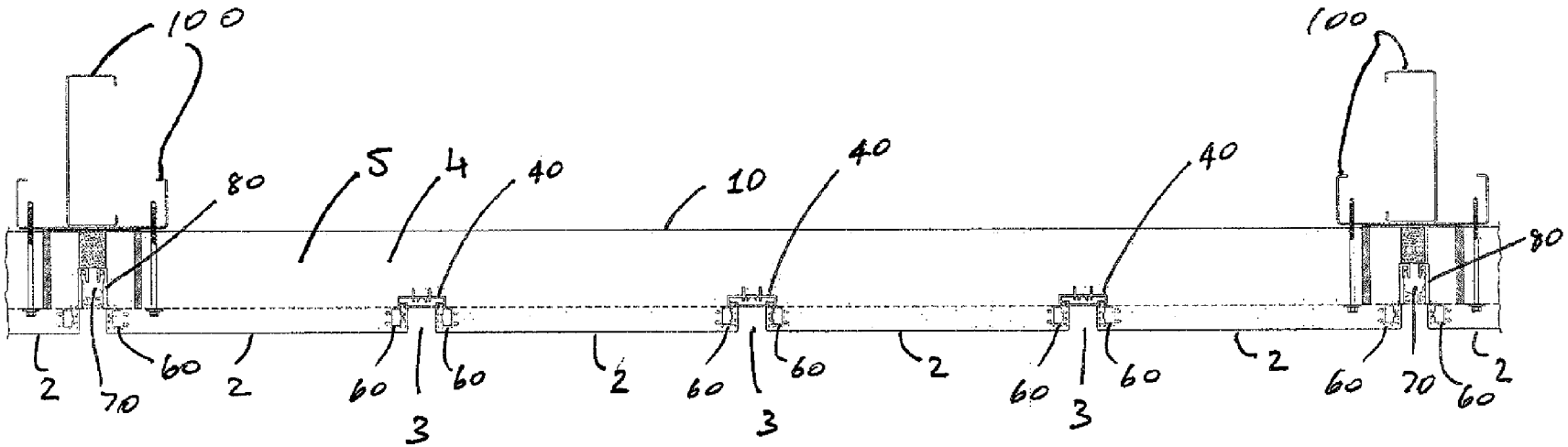
FIG. 1 is a cross sectional view of a composite insulating and cladding panel system according to the invention, in situ.
Figure 2:
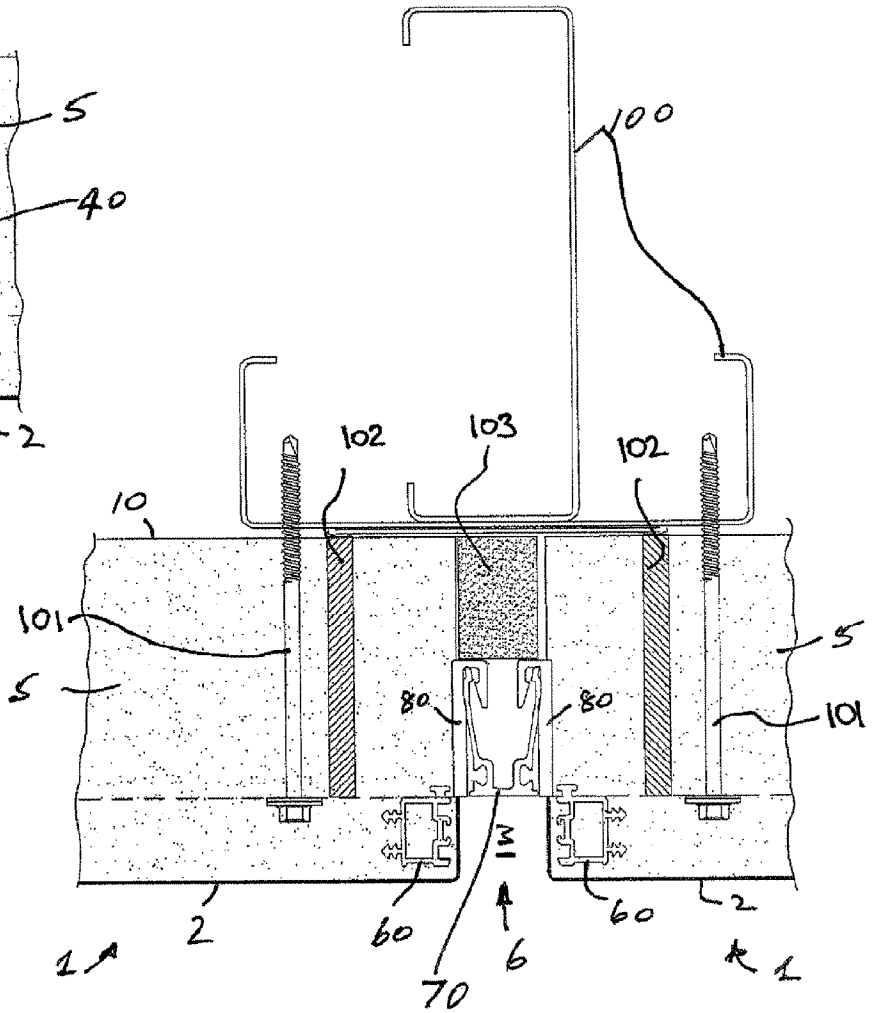
FIG. 2 is an enlarged view of a joint detail between adjacent insulating and cladding panels of the invention.
Figure 3:
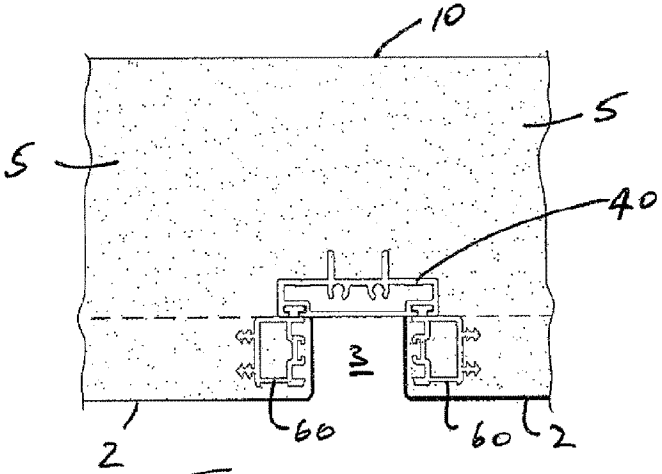
FIG. 3 is an enlarged cross sectional view of a detail between two adjacent cladding parts in a composite insulating and cladding panel of the invention.

Referring to the drawings there is illustrated a composite insulating and cladding panel 1 comprising a backing sheet 10, a plurality of cladding parts 2, and a support grid between the backing sheet 10 and the cladding parts 2. The cladding parts 2 are mounted to the support grid, and a body of insulating material 5 is provided between the backing sheet 10, the support grid and the cladding parts 2. The insulating body is in this case an insulating foam 4. The foam may, for example be of polyisocyanurate foam or a phenolic foam. In use, the composite cladding and insulating panels 1 are mounted to building framework elements 100 as illustrated in FIG. 1. Joints 6 between adjacent similar cladding and insulating panels 1, in situ cladding a building, are illustrated in FIGS. 1 and 2.

Figure 27:
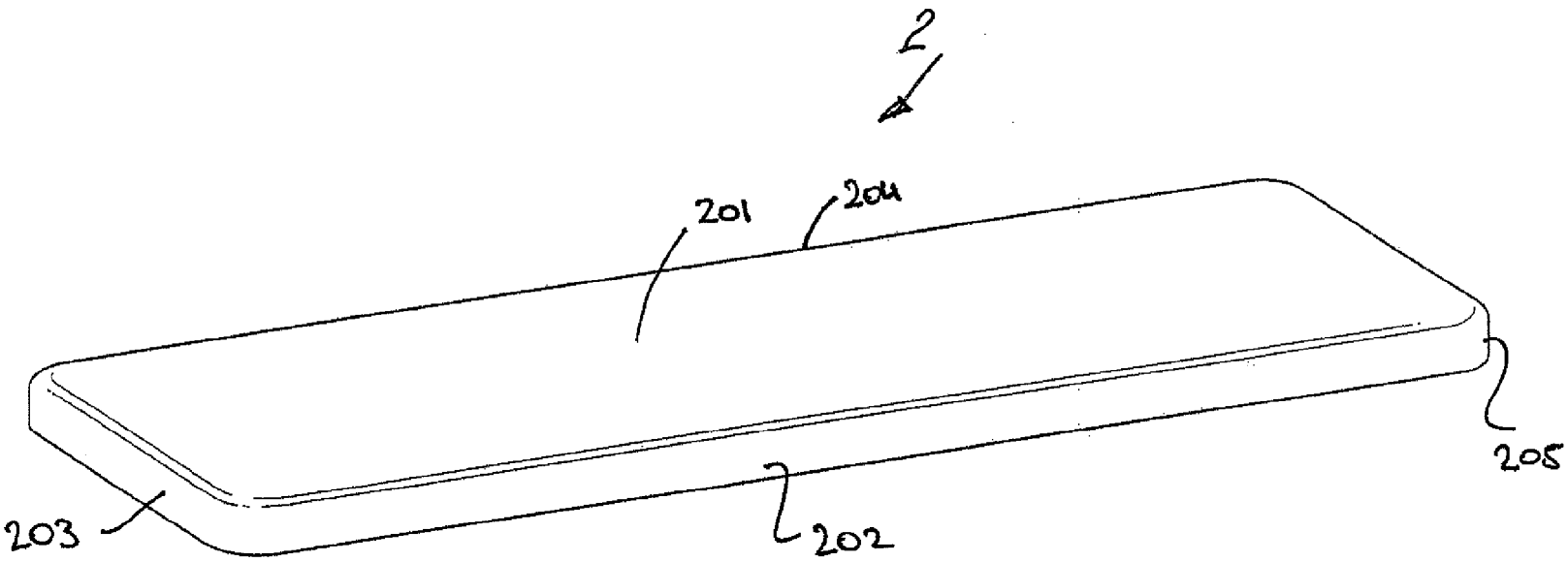
FIG. 27 is a perspective view of a cladding part.

The panel 1 comprises a plurality cladding parts 2 which in this case are spaced-apart to provide aesthetically pleasing gaps 3 therebetween. One cladding part 2 which has rounded corners is illustrated in FIG. 27. The cladding part 2 may have an exterior face 201, and peripher walls forming an inturned flange with sides 202, 203, 204. The cladding part 2 has rounded corners 205. The cladding parts 2 may have any desired surface finish such as natural or artificial brick, stone, wood, paint and the like. The cladding parts 2 in one panel may present the same or different visual effects. For example, one or more may be of a different colour to the others. Furthermore the cladding parts may be of different sizes within one panel (for example the may range in size from 300 mm×300 mm to 3860 mm×1200 mm as mentioned below). While cladding parts will commonly be of rectangular or square shapes, any shape can be used. Any combination of cladding parts can be used within a panel, so this can achieve a combination of different sizes, orientation, shapes, colours or finishes. Irrespective of whether one cladding part, identical cladding parts, or a combination of different cladding parts are chosen for a panel the elements forming the support grid part of the invention allows the cladding part(s) to be assembled in a composite panel. Furthermore each panel may be different in size, orientation and of course may have one or more different cladding parts that a given panel. In the invention the cladding parts 2 provide a finished façade which is integrated into the panel during manufacture and the panel incorporates a support grid which transfers load directly to a building structural framework without a requirement for separate additional building structural frames. In addition, the panels 1 have interengagable features which facilitate joining between a plurality of panels to form a finished façade which can be assembled off-site and easily erected on-site with minimum on-site work to mount the façade to the building support framework. This represents a major improvement over existing façade systems. The composite insulation and cladding panel has mechanical and insulation properties that are similar to those of a conventional composite insulating panel of a similar size. This means that it can span without the need for additional support elements in the building framework to which it is attached. In terms of loading and wind resistance its performance is similar to that of a standard composite panel. Thus, the cladding panels of the invention can be incorporated into a building cladding at any desired location(s), thus providing architectural design flexibility.

The cladding parts 2 may be of metallic material such as aluminium with rounded corners. They may have any suitable finish such as zinc, copper or stainless steel. They may have an anodized finish, be pre-painted or post-painted or post powder coated. They may for example range from 300 mm×300 mm to 3860 mm×1200 mm. They may have an inturned flange that fits to a frame of frame elements 60, for example as a tolerance fit. Any flange may have a depth that may be about 24 mm.

Figure 4:
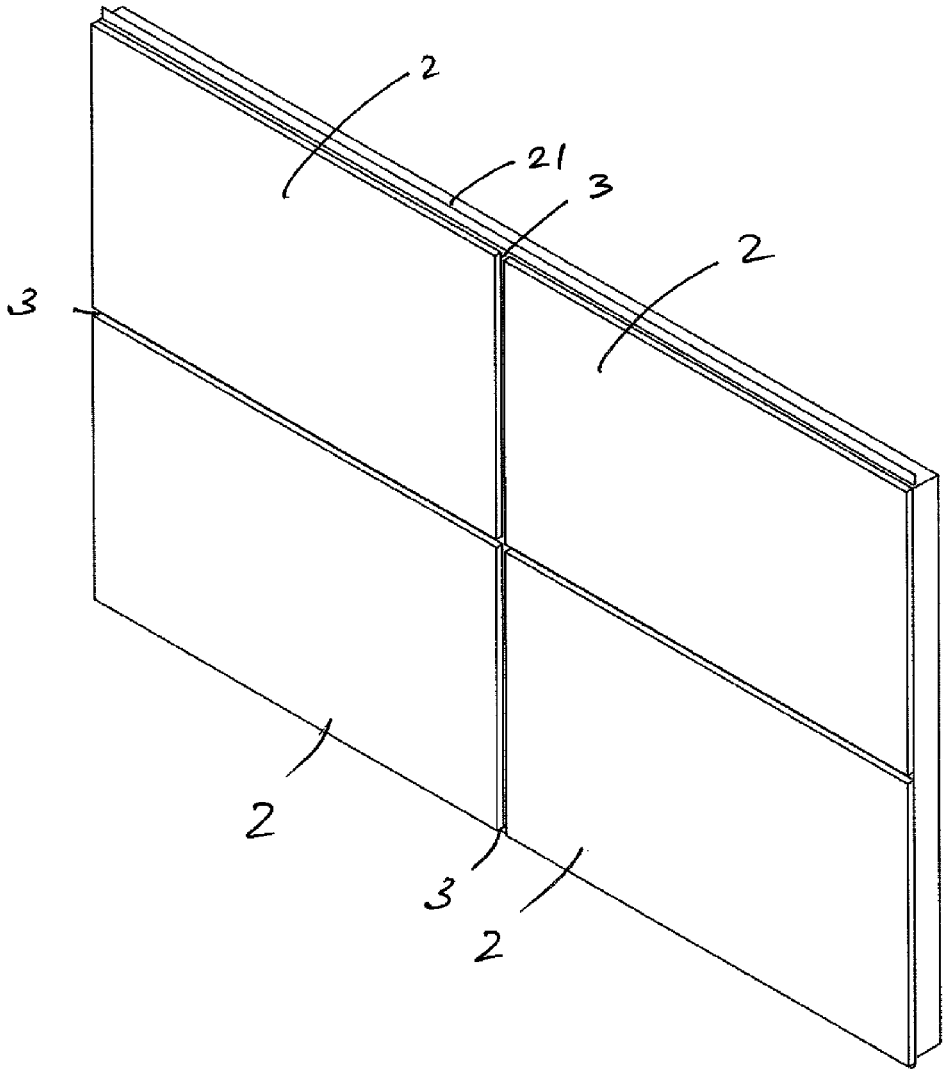
FIG. 4 is a perspective view of a composite insulating and cladding panel according to the invention.
Figure 5:
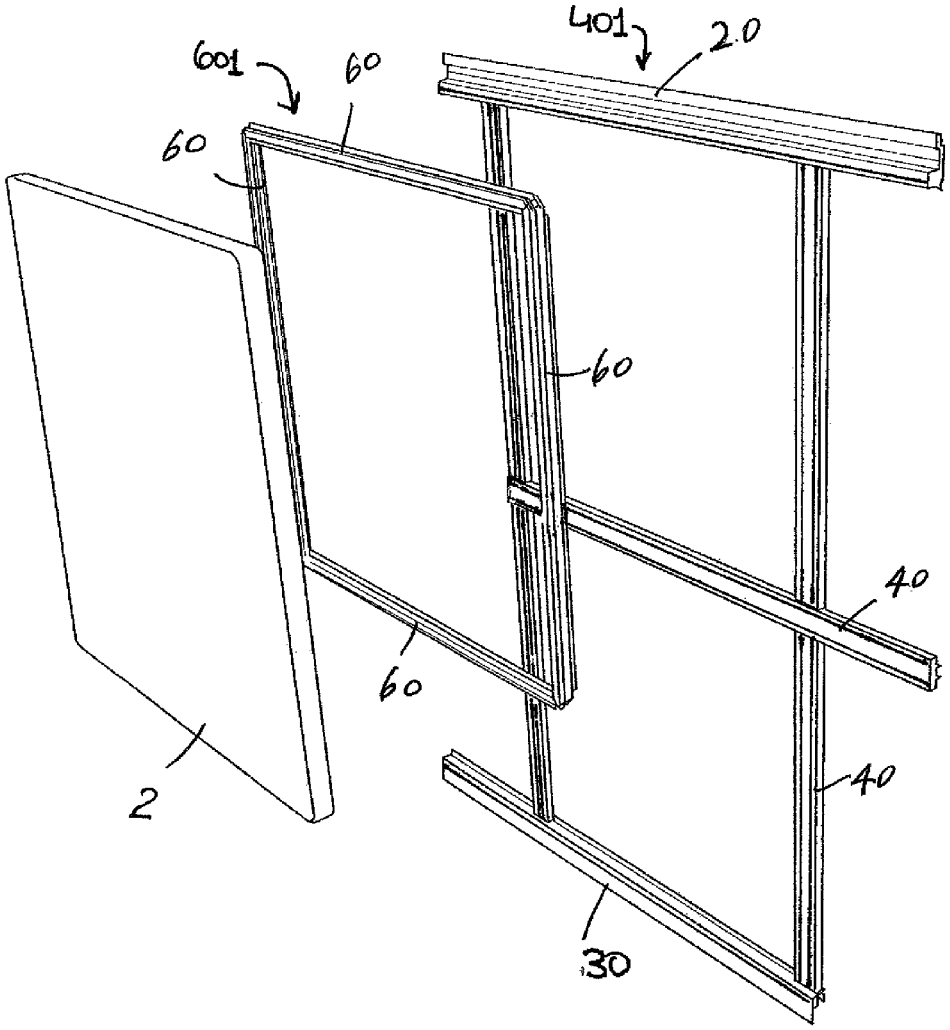
FIGS. 5 and 6 are exploded views of part of the panel.

In the arrangement shown in FIG. 4 the panel 1 comprises two rows each of two cladding parts 2 held apart in a spaced apart relationship by the support grid.

One important aspect of the invention is the integral support grid. The integral support grid comprises a number of grid elements examples of which are shown individually in FIGS. 20 to 26 and at various stages of assembly in FIGS. 5 to 19.

Figure 20:
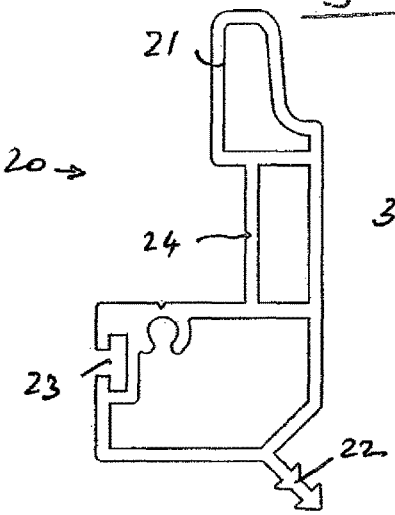
FIG. 20 is a cross sectional view of a male adaptor element.

Referring to FIG. 20, there is illustrated a male adaptor edge element 20 which, in the embodiment illustrated (for example in FIG. 5), extends transversely across the top edge in use of the panel. The male adaptor edge element 20 has a male projecting part 21, and a T-shaped grove 23. There is a lead-in notch 24 to guide fixing screws. An anchorage leg 22 is provided for anchoring in the insulating material 5.

Figure 21:
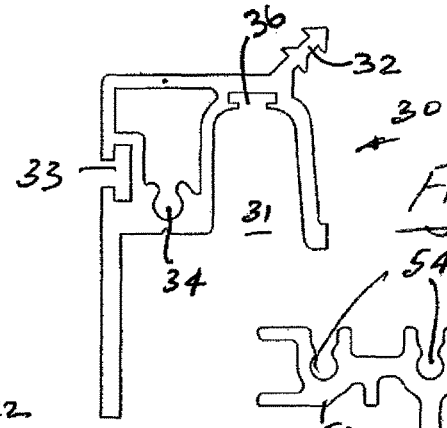
FIG. 21 is a cross sectional view of a female adaptor element.

Referring to FIG. 21 there is illustrated a female adaptor edge element 30 which, in the embodiment illustrated (for example in FIG. 5) extends transversely across the bottom edge in use of the panel. The female adaptor edge element 30 has a female recess 31, and a T-shaped groove 33. There is a fixing port 34 to guide a fixing screw. The female recess 31 is sized and shaped for engagement with a male projecting part 21 of a male adaptor edge element 20 of an adjacent panel. An anchorage leg 32 is provided for anchoring in the insulating material 5. A seal such as a bubble seal 36 (see FIGS. 16 to 18) may be provided in T-shaped groove 36.

It will be appreciated that in a panel that is to be fixed in a different orientation, for example in a vertical orientation the male and female adapter edge elements may extend along the sides of the panel.

Figure 22:
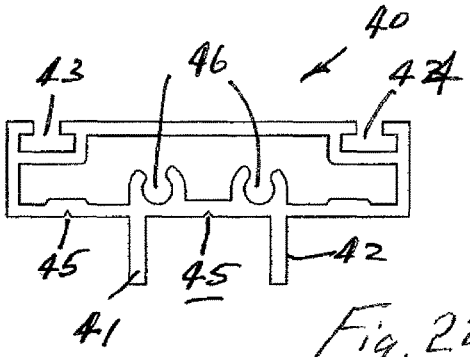
FIG. 22 is a cross sectional view of a mullion element.

A mullion element 40 of the support grid is illustrated in FIG. 22. There are two spaced-apart projections 41, 42 on one side and T-shaped grooves 43, 44 on the opposite sides. Notches 45 are provided to guide fixing screws. There are also two internal receivers 46 for fixing screws.

Figure 14:
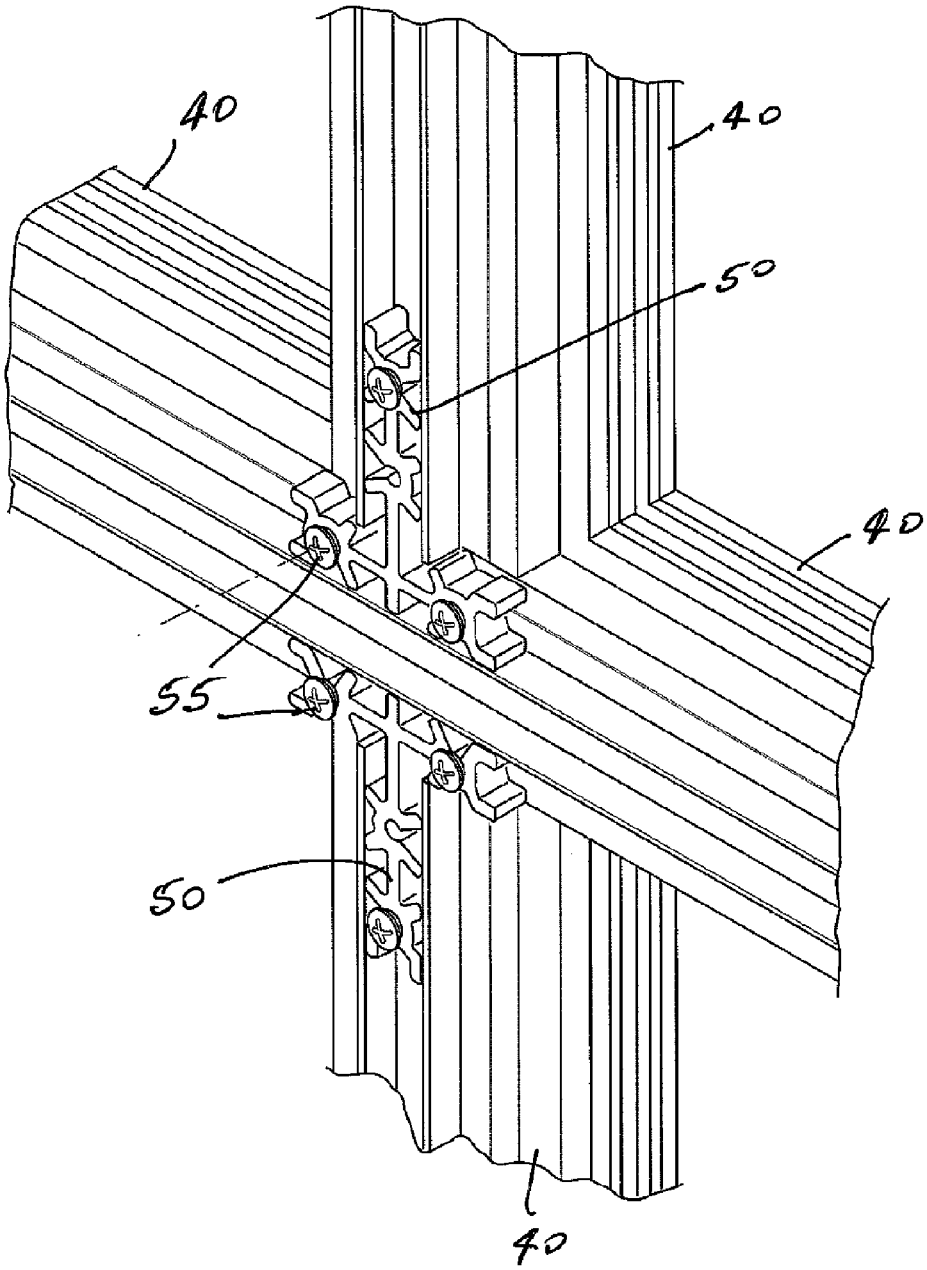
FIG. 14 is an enlarged view illustrating joint the between adjacent mullions.
Figure 15:
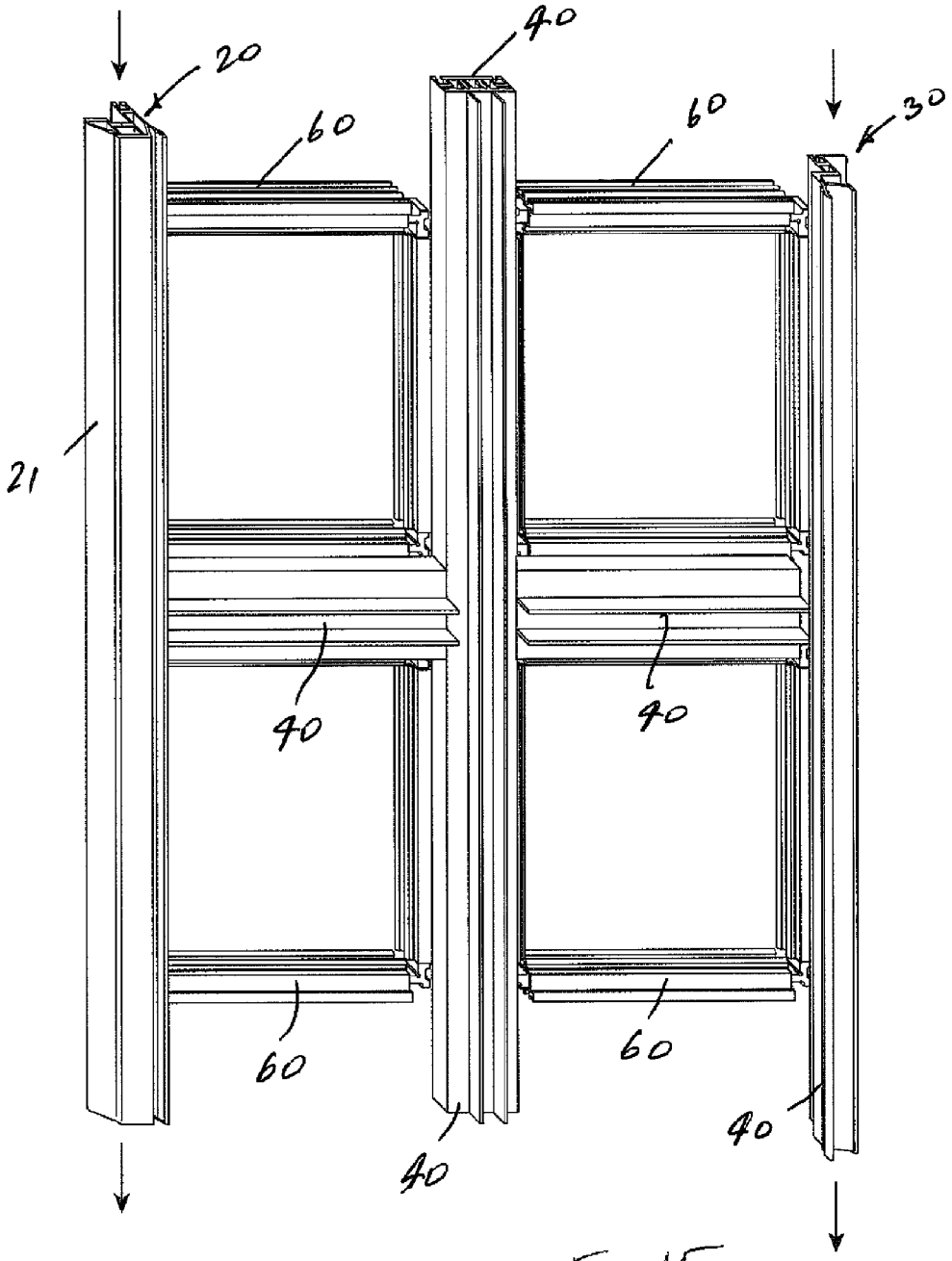
FIG. 15 is a perspective view of the grid of FIG. 13 with male and female adaptor edge elements in place.
Figure 23:
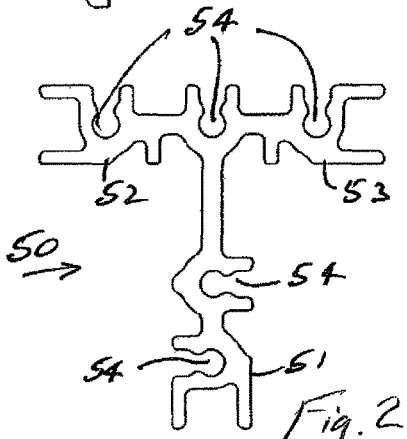
FIG. 23 is a cross sectional view of a T-piece connector element.

An element in the form of a T-piece 50 for interconnecting adjacent mullion elements 40 in a support grid is illustrated in FIG. 23. The T-piece defines three arms 51, 52, 53, each of which has holes 54 to received fixing screws 55 as illustrated in FIG. 14.

Figure 24:
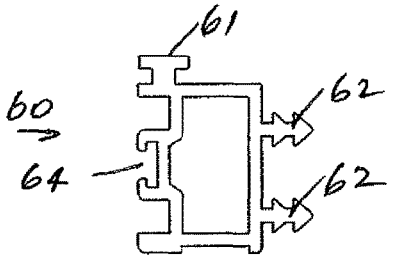
FIG. 24 is a cross sectional view of a cladding frame element.

A frame adaptor element 60 that is used to frame the individual cladding parts is illustrated in FIG. 24. The frame adaptor element 60 has a T-bar projection 61 that is engagable in the correspondingly shaped grooves 23, 33 of the male and female adaptor elements. There are also anchorage legs 62 for anchoring in the insulating material 5. The frame adapter element 60 may have within a T-shaped groove 64 an engaging element such as a brush or rubber gasket element that acts to engage with the cladding part 2.

Figure 25:
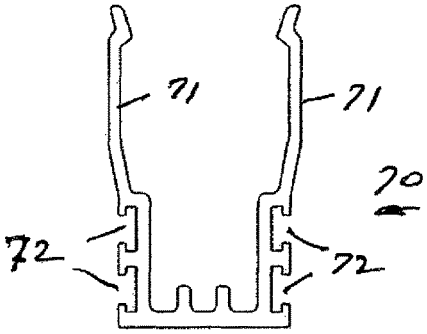
FIG. 25 is a cross sectional view of a snap-in cover element.

FIG. 25 illustrates a cladding part in the form of a cover element 70 which has two projecting arms 71 that extends to embrace a panel end extrusion element 80. The cover element 70 also has four T-shaped grooves 72 which facilitate application of a weather seal to aid weather proofing of the vertical joints. In some cases a push-in gasket may be used as an alternative to the cover element 70.

The frame adapter element 60, the male adaptor edge element 20 and the female adapter edge element 30 and the mullions 40 are desirably each formed as continuous profiles, for example by extrusion, that can be cut to a desired length. Once the size and orientation of the panel, and the size, shape, and orientation of the cladding parts are known the composite panel can be assembled. This allows complete versatility in the formation of the panel design.

Figure 26:
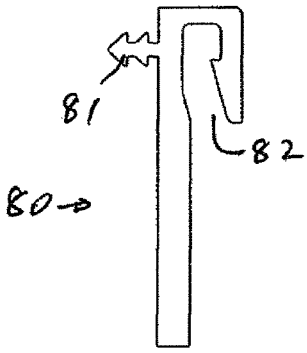
FIG. 26 is a cross sectional view of a panel end extrusion element.

The panel end extrusion element 80 is illustrated in FIG. 26. The end extrusion element 80 has a projection 81 which provides an anchor for insulation and a groove 82 to receive the cover element 70.

Figure 6:
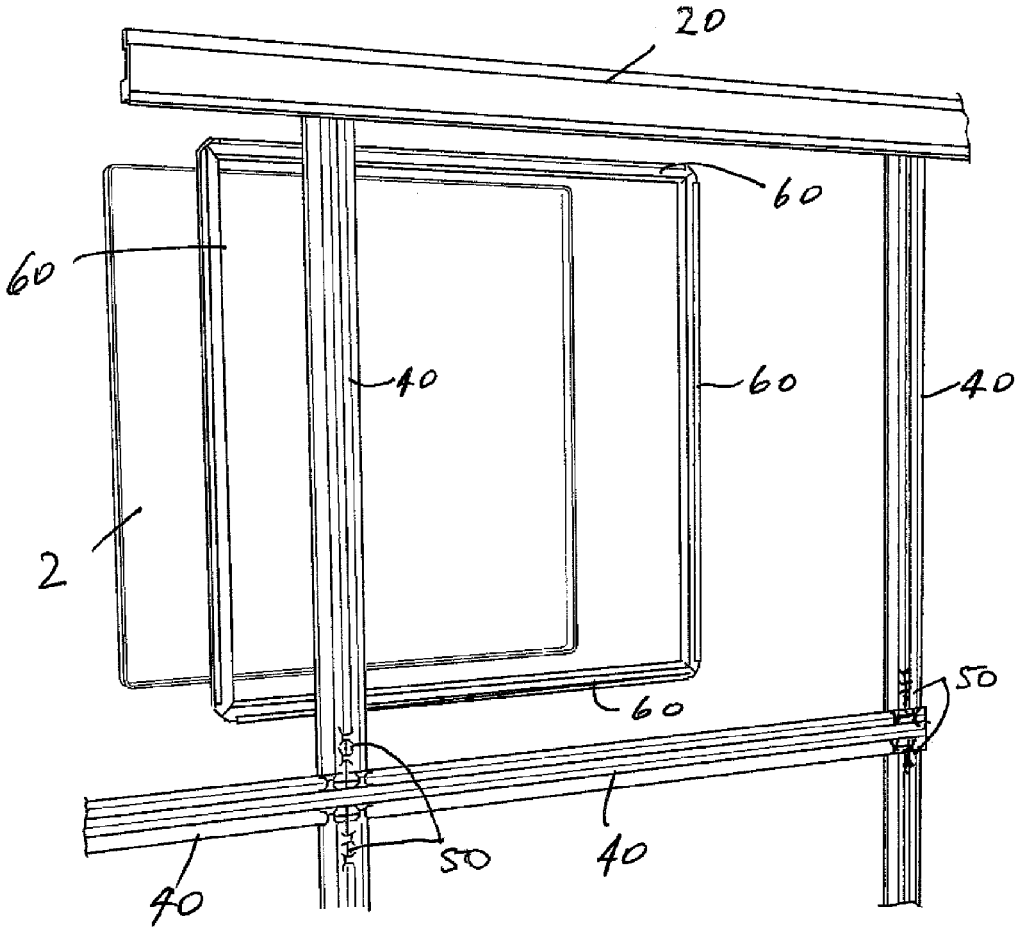
Figure 9:
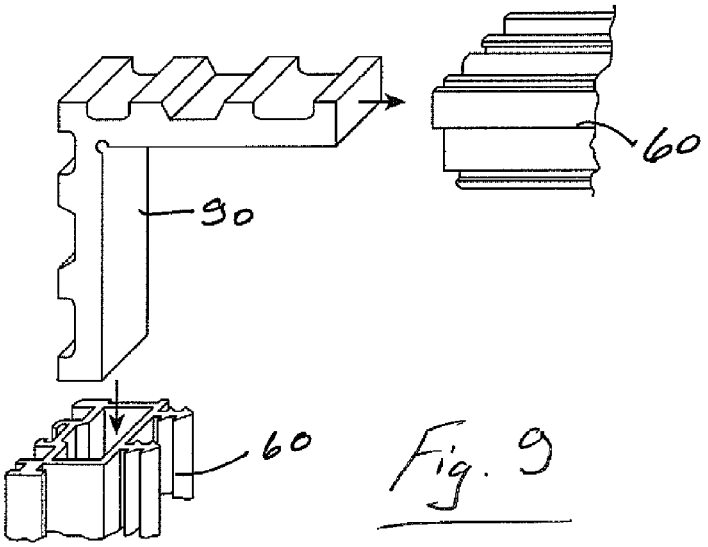
FIG. 9 is an exploded view of a corner connection of the grid of FIG. 7.
Figure 7:
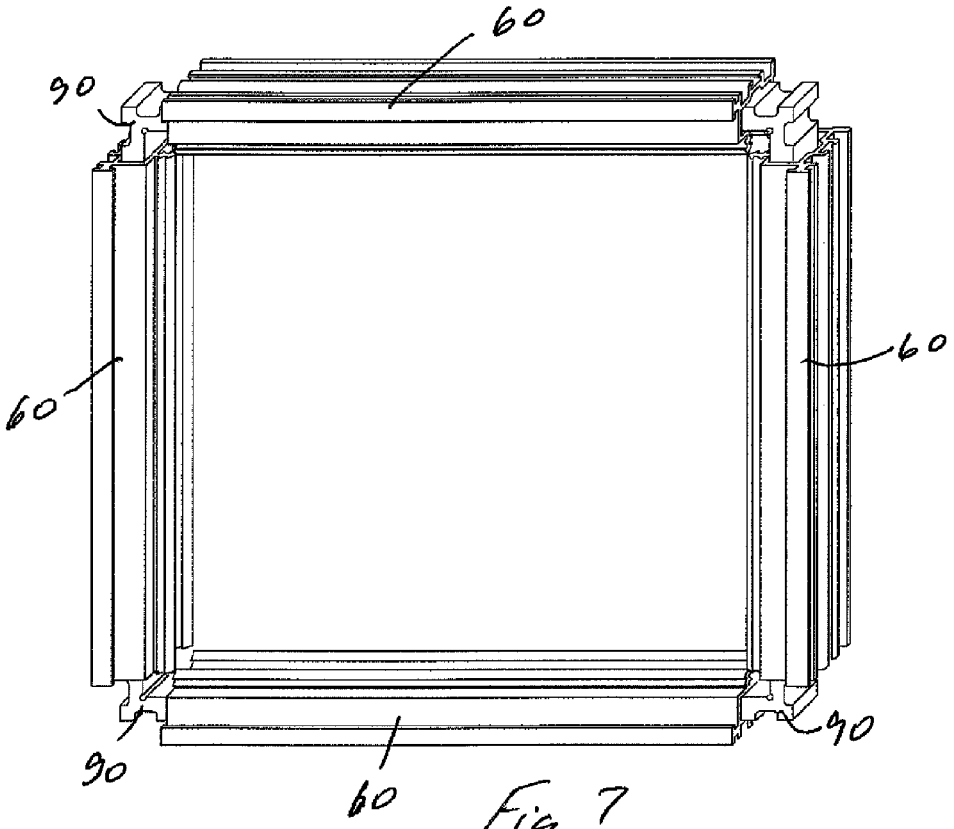
FIG. 7 is a perspective view of a part of a support grid for one cladding part of the panel.
Figure 8:
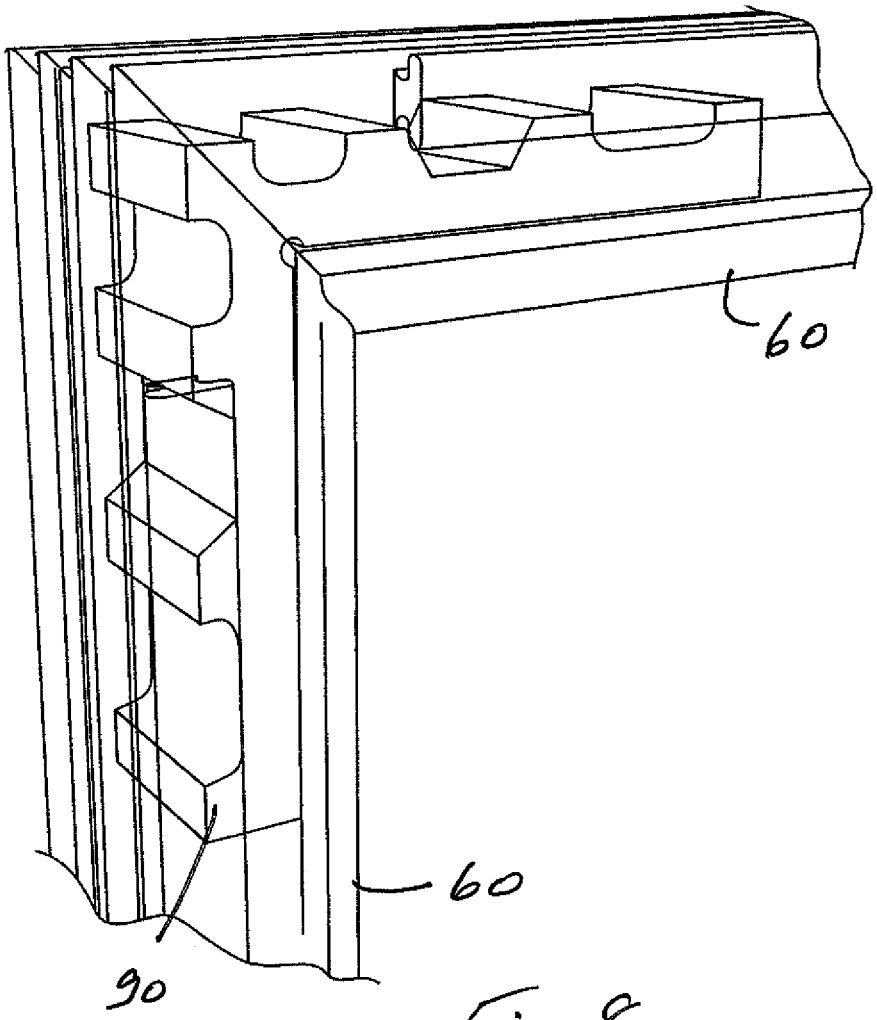
FIG. 8 is a view of a corner joint detail of FIG. 7.
Figure 11:
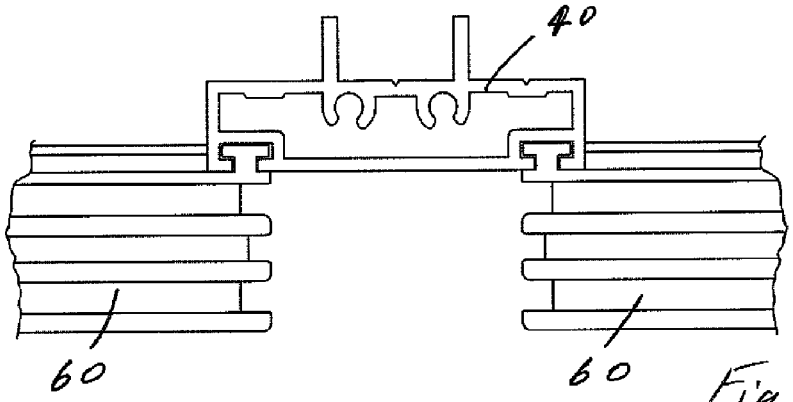
FIG. 11 is a cross sectional view of a joint between adjacent grids of FIG. 10.
Figure 10:
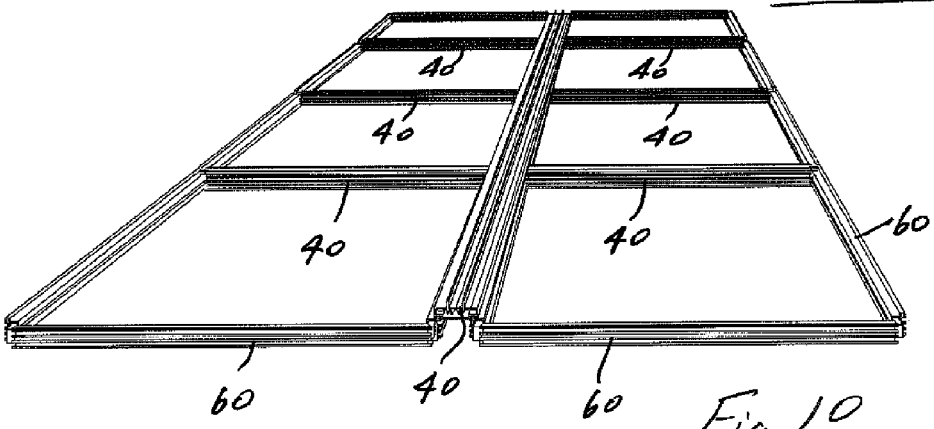
FIG. 10 is a perspective view of a number of support grids of FIG. 7 joined together.
Figure 12:
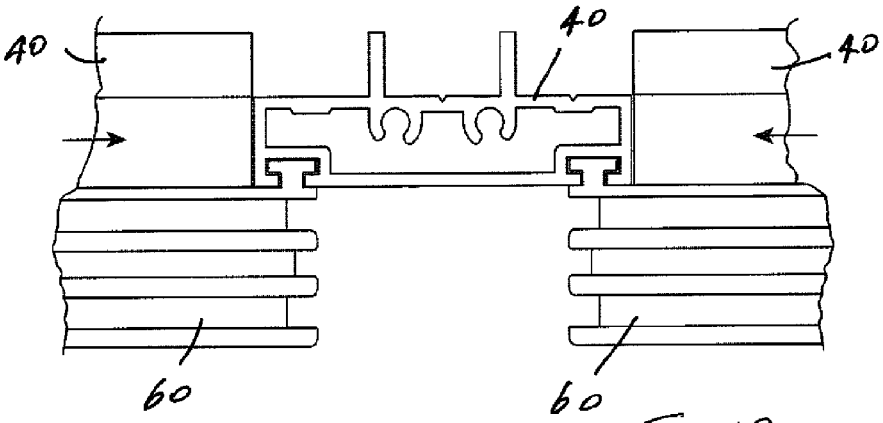
FIG. 12 is a cross sectional view showing the vertical mullion in place (for example the vertical mullion that is in place at the joint 3 in FIG. 4)
Figure 13:
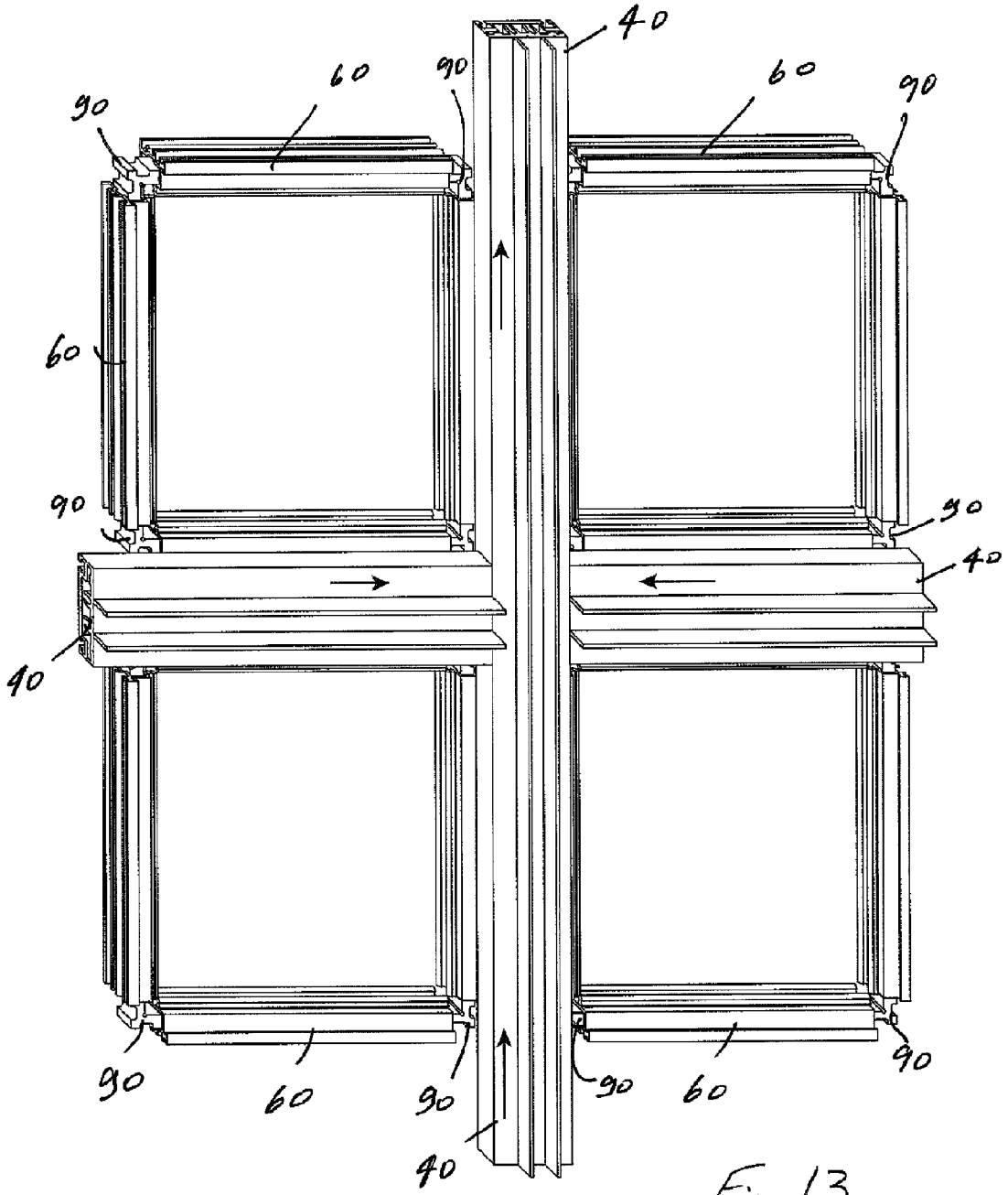
FIG. 13 is a perspective view illustrating the grids with mullions between adjacent grids of cladding parts.

A frame assembly 601 for an individual cladding part 2 is illustrated in FIGS. 5 to 9. Four of the frame elements 60 are used to form a rectilinear frame 601. The frame elements 60 may be mitred at the corners (as shown in FIG. 6) and interconnected by L-shaped brackets 90 as illustrated particularly in FIGS. 8 and 9. Mitred corners are used when the cladding element has mitred corners also for example as shown in FIG. 27. Even though the frame assembly is shown as square it will be appreciated that a frame can be assembled to any desired shape.

A number of frame assemblies 601 are then interconnected as illustrated in FIGS. 10 to 13 using horizontally and vertically arranged mullion elements 40. The groves 43, 44 of the mullion element 40 are slidingly engaged in the corresponding T-shaped projections 61 of the frame elements 60. It will be appreciated that male adaptor elements 20 and female adapter elements 30 will be attached to opposing sides of the panel (this can be on the left and right or top and bottom) to allow interconnection of adjacent panels.

The mullions elements 40 are interconnected as illustrated in FIG. 14 using the T-pieces 50 (and appropriate screw fasteners)

Figure 16:
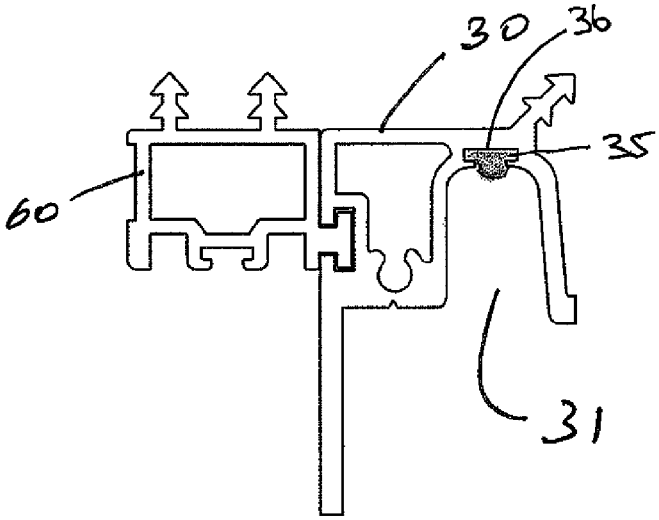
FIGS. 16 to 18 are respective cross sectional views illustrating the sequence for joining and the joint between male and female adaptor edge elements of adjacent panels.
Figure 16:
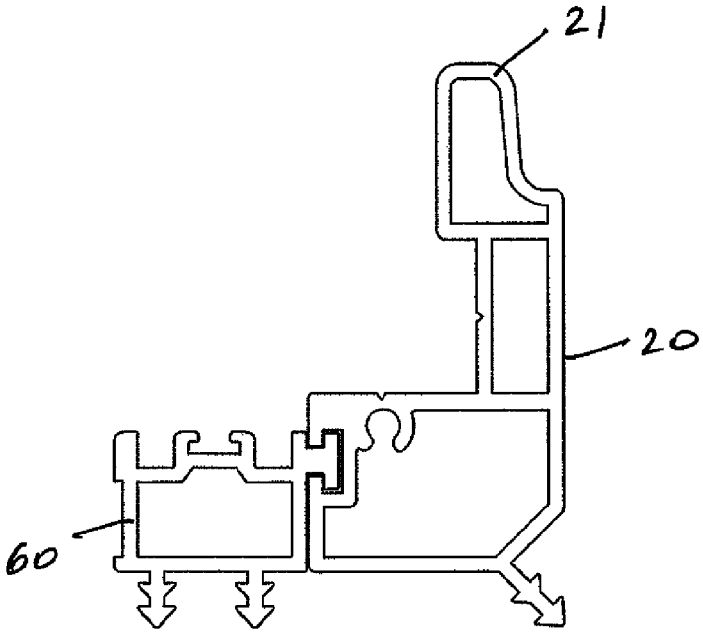
Figure 17:
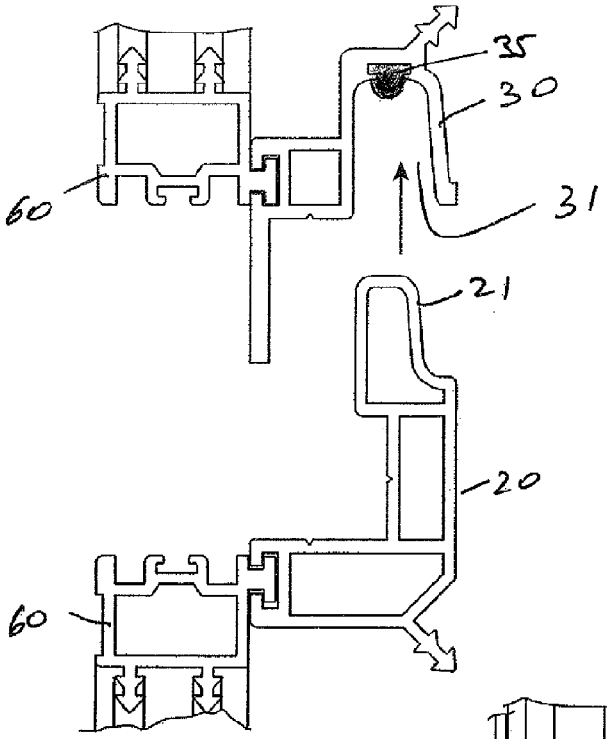
Figure 18:
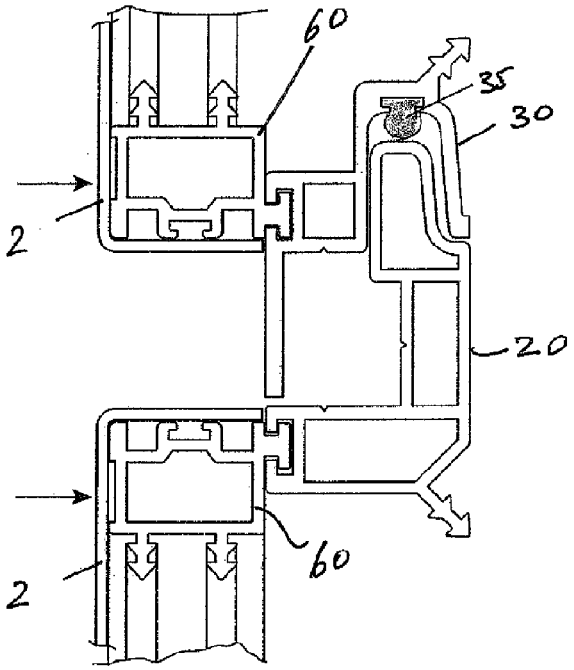
Figure 19:
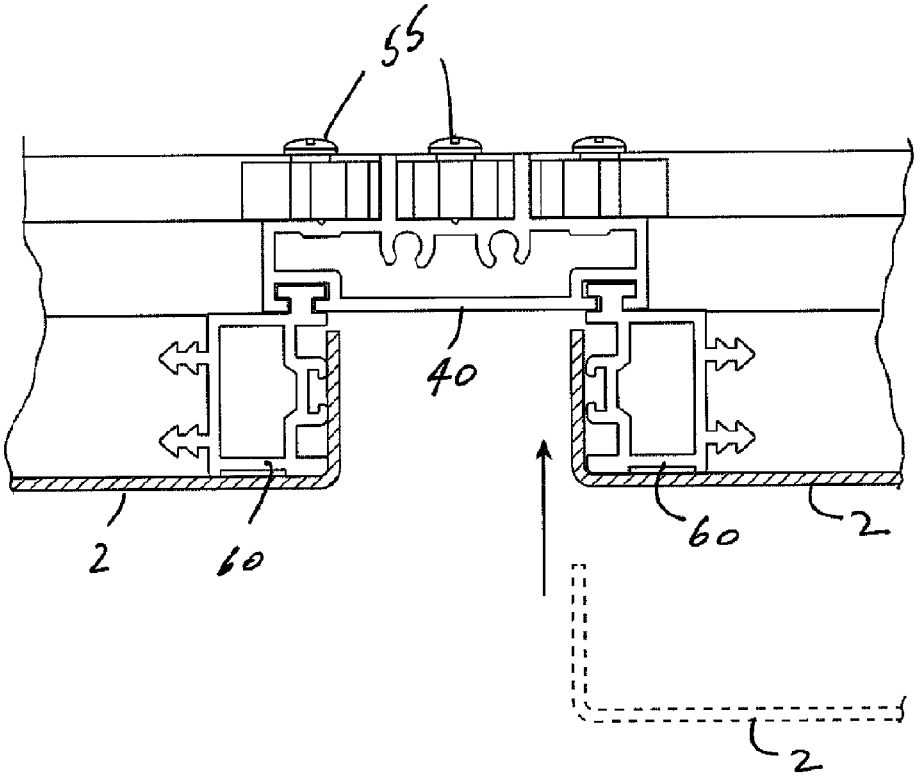
FIG. 19 is a cross sectional view of portion of the support grid with cladding parts in situ.

Male and female adaptor elements 20, 30 are attached as illustrated in FIGS. 16 to 18. The grooves 23 and 33 of the male and female adaptor elements 20, 30 are engaged with the T-bars 61 of the adjacent frame adaptor elements.

The male adaptor element 20 of one panel is engagable with the female adaptor element 30 of an adjacent panel to build up a façade using a plurality of the panels. The joint is shown in detail in FIGS. 16 to 18.

With reference to FIGS. 1 and 2, the end extrusion element 80 and cover element 70 (as shown in detail in FIGS. 25 and 26) are used to join adjacent panels together on those sides that are not joined by the male and female adaptor elements 20,30. In such configuration they provide a weather-proofing for the joint 6.

Also in FIGS. 1 and 2 are shown fixing screws 101 for fixing the panel 1 to the support structure 100. In those Figures the screws 101 have been inserted through the male adaptor element 30 (the position of which is indicated with a dashed line). To avoid air leakage between panels sealing elements 102 are provided. They may be provided as a flowable composition that cures to form a seal. An insulation material, for example in the form of a board 103 is provided to provide continuity of the insulation in the joint 6 between adjacent panels 1.

A composite insulating and cladding panel of the invention may be manufactured by first manufacturing a support grid, then attaching the cladding parts to the grid, applying a backing sheet and finally injecting liquid foam reactants to fill the spaces between the backing sheet, the support grid, and the cladding parts to form a composite insulating and cladding panel filled with an insulation foam. In some cases an alternative insulating material such as a mineral wool may be used.

In one case a mitre saw is first used to cut the rails (profiles) to a required size. The frame adapter elements 60 are then attached together, for example by crimping, to form the shape of the tray of the cladding parts 2 that they fit into. A number of such frames are then joined together longitudinally and/or transversely using mullion elements 40 where necessary. The grid may be, for example a 4×2 grid. The male and female adaptor elements 20, 30 are then attached in the desired configuration to the frame adapter elements 60, as described above, and adjacent mullions 40 are attached to each other using the tee-pieces 50. The mullions may be attached to the male and female adapter elements 20,30 by screws. The end piece 80 is then positioned and fixed to the adapter elements 20, 30 again using screws. The grid frame is now complete and the cladding parts are installed. A backing tray 10 is applied and liquid foam reactants are injected to fill the spaces between the backing sheet 10, cladding parts 2, and the support grid.

Various aspects described with reference to one embodiment may be utilised, as appropriate, with another embodiment.

Many variations on the embodiments described will be readily apparent. Accordingly the invention is not limited to the embodiments hereinbefore described which may be varied in detail.

The invention claimed is:

1. A composite insulating and cladding panel comprising:

a backing sheet;

a plurality of cladding parts forming an external façade for an exterior of a building, each cladding part including an exterior face and an inturned flange;

a support grid positioned between the backing sheet and the cladding parts such that the backing sheet defines a surface of the panel that abuts a building support structural framework, the support grid transfers load directly to the building structural framework, the support grid includes a frame including a plurality of frame adapter elements, each frame with a peripheral surface to receive each of a like number of the plurality of cladding parts, the inturned flange of each of the plurality of cladding parts engages a like one of the plurality of frame adapter elements of the support grid frame to fit each of the plurality of cladding parts with the support grid, the plurality of cladding parts define an exterior face of the panel and gaps are formed between adjacent cladding parts of the plurality of cladding parts; and a body of insulating material between the backing sheet, the support grid and the cladding parts.

2. A panel as claimed in claim 1 wherein the support grid comprises:

a male adaptor edge element having a male projecting part extending along one edge of the panel; and a female adaptor edge element having a female recess part extending along an opposite edge of the panel.

3. A panel as claimed in claim 2 wherein the support grid comprises a plurality of mullion elements extending between the female adaptor edge element and the male adaptor edge element.

4. A panel as claimed in claim 3 comprising a plurality of connectors extending between the mullion elements.

5. A panel as claimed in claim 1 wherein each cladding part is generally rectilinear tray shape having the inturned edges.

6. A panel as claimed in claim 5 wherein the edges comprise rounded corner portions.

7. A cladding system comprising a plurality of panels as claimed in claim 1.

8. A building comprising a plurality of panels as claimed in claim 1.

9. A composite insulating and cladding panel comprising:

a backing sheet;

a plurality of cladding parts, each cladding part including an exterior face and an inturned flange;

a support grid positioned between the backing sheet and the cladding parts such that the backing sheet defines a surface of the panel that abuts a building structural framework, the support grid includes a frame including a plurality of frame adapter elements, each frame with a peripheral surface to receive each of a like number of the plurality of cladding parts, the inturned flange of each of the plurality of cladding parts engages a like one of the plurality of frame adapter elements of the support grid frame to fit each of the plurality of cladding parts with the support grid, the plurality of cladding parts define an exterior face of the panel exposed to environmental elements, the support grid transfers load directly to the building structural framework;

the cladding parts are spaced-apart to define gaps between adjacent cladding parts and the support grid is adjacent the gaps and is exposed to the environmental elements to maintain weatherproofing of the panel; and a body of insulating material between the backing sheet, the support grid and the cladding parts.

10. A composite insulating and cladding panel for a building comprising a building support structural framework, the panel comprising:

a backing sheet for forming an interior face of the panel which faces to the interior of the building;

a plurality of cladding parts defining an exterior face of the panel the cladding parts facing to the exterior of the building and forming an external façade for the exterior of the building, each cladding part including an exterior face and an inturned flange;

a support grid positioned between the backing sheet and the cladding parts, the support grid for transferring load directly to the building structural framework, the support grid transfers load directly to the building structural framework, the support grid includes a frame including a plurality of frame adapter elements, each frame with a peripheral surface to receive each of a like number of the plurality of cladding parts, the frame projects from the support grid, the inturned flange of each of the plurality of cladding parts engages a like one of the plurality of frame adapter elements of the support grid frame to fit each of the plurality of cladding parts with the support grid; and a body of insulating material between the backing sheet, the support grid and the cladding parts.

11. A panel as claimed in claim 10 wherein the support grid comprises:

a male adaptor edge element having a male projecting part extending along one edge of the panel; and a female adaptor edge element having a female recess part extending along an opposite edge of the panel.

12. A panel as claimed in claim 11 wherein the support grid comprises a plurality of mullion elements extending between the female adaptor edge element and the male adaptor edge element.

13. A panel as claimed in claim 12 comprising a plurality of connectors extending between the mullion elements.

14. A panel as claimed in claim 10 wherein each cladding part is generally rectilinear tray shape having the inturned edges.

15. A cladding system comprising a plurality of panels as claimed in claim 10.

16. A building comprising a plurality of panels as claimed in claim 10.

* * * * *